United States Patent [19]

Noguchi et al.

[11] 4,076,534

[45] Feb. 28, 1978

[54] HEAT DEVELOPABLE LIGHT-SENSITIVE MATERIAL

[75] Inventors: Yasuhiro Noguchi; Nobuyoshi Sekikawa; Kenji Sashihara; Takao Masuda, all of Asaka, Japan

[73] Assignee: Fuji Photo Film Co., Ltd., Minami-ashigara, Japan

[21] Appl. No.: 708,450

[22] Filed: Jul. 26, 1976

Related U.S. Application Data

[63] Continuation of Ser. No. 515,375, Nov. 16, 1974, abandoned.

[30] Foreign Application Priority Data

Nov. 16, 1973 Japan ..... 48-116022
Nov. 17, 1973 Japan ..... 48-116471

[51] Int. Cl.[2] ..... G03C 5/24; G03C 1/06; G03C 1/02

[52] U.S. Cl. ..... 96/63; 96/114.1; 96/95

[58] Field of Search ..... 96/114.1, 95, 52, 66 T, 96/63

[56] References Cited

U.S. PATENT DOCUMENTS

| | | | |
|---|---|---|---|
| 3,080,254 | 3/1963 | Grant | 96/114.1 |
| 3,547,648 | 12/1970 | Sagawa | 96/114.1 |
| 3,645,739 | 2/1972 | Ohkubo et al. | 96/114.1 |
| 3,885,967 | 5/1975 | Sashihara et al. | 96/114.1 |

*Primary Examiner*—David Klein
*Assistant Examiner*—Louis Falasco
*Attorney, Agent, or Firm*—Sughrue, Rothwell, Mion, Zinn and Macpeak

[57] ABSTRACT

A heat developable light-sensitive material comprising a support having thereon at least one light-sensitive layer containing (1) an oxidation-reduction image-forming combination of (a) a silver salt oxidizing agent and (b) a reducing agent and (2) a catalytic amount of a light-sensitive silver halide or a compound capable of reacting with the silver salt (a) to form a light-sensitive silver halide, the light-sensitive layer further containing (3) at least one specific phthalazinone compound. The development of the above light-sensitive material is carried out simply by heating the material at a temperature of about 90° to 180° C. for 1 to 60 seconds after imagewise exposure. An image of black tone can be obtained without contaminating the developing machine.

11 Claims, No Drawings

HEAT DEVELOPABLE LIGHT-SENSITIVE MATERIAL

This is a Continuation, of application Ser. No. 515,375, filed Nov. 16, 1974, now abandoned.

BACKGROUND OF THE INVENTION

1. Field of the Invention

This invention relates to a heat developable light-sensitive material, and more specifically, to an improved heat developable light-sensitive material using a novel toning agent and capable of providing a black image.

2. Description of the Prior Art

Photographic processes using silver halide have been most widely used heretofore because of their superiority in photographic characteristics such as sensitivity or gradient to the characteristics of electrophotographic or diazo photographic processes. Silver halide photographic materials are processed with a liquid developer, and then subjected to various treatments using liquids such as stopping, fixation, rinsing or stabilization in order to stabilize the undeveloped background. Accordingly, these processing steps require time and labor, and there is a risk to the working personnel due to the handling of chemicals. These chemicals also cause contamination of the processing room and the hands or clothes of the worker.

In order to remove the above defects of silver halide photographic processes, various attempts have been made to use a heat developable photographic process which does not employ treatment with chemical solutions in which a heat developable light-sensitive material is exposed, and the resulting latent image is developed by heating the light-sensitive element and, at the same time, stabilized.

Various types of heat developable light-sensitive materials are known. For example, U.S. Pat. Nos. 3,394,393, 3,394,394, and 3,391,395 disclose methods in which a combination of a lower haloalkane as a photoactivator and a furfurylidene compound as a dye-forming agent is exposed, and then heated for development.

Other dry developing methods using heat and light-sensitive elements therefore are disclosed in Japanese Patent Publication No. 2096/63 and U.S. Pat. Nos. 3,152,904, 3,457,075 and 3,635,719. These processes rely on using a heat developable light-sensitive material comprising a silver salt oxidizing agent such as a long-chain aliphatic carboxylic acid silver salt, silver saccharin or silver benzotriazole, a suitable reducing agent, and a light-sensitive catalyst, such as a silver halide, for this oxidizing agent-reducing agent combination.

Of the two approaches discribed above, the present invention belongs to the latter approach.

Heat developable light-sensitive materials using silver salt oxidizing agents, in most cases, provide only yellowish brown images, but it is known that they can be improved to give images of a black tone by adding a toning agent. Examples of toning agents are phthalazinone, and 2-pyrazolin-5-one, quinazoline and cyclic imides disclosed in U.S. Pat. No. 3,846,136.

However, toning agents which have been proposed so far have various defects. For example, they do not provide a pure black tone, and in particular, light-sensitive materials which have been stored in the original form for prolonged periods of time undergo deterioration in tone with the result that the tone becomes brownish. Alternatively, the toning agent volatilizes from the light-sensitive material at the time of development by heating and contaminates the developer machine used.

SUMMARY OF THE INVENTION

Accordingly, an object of this invention is to provide a heat developable light-sensitive material which provides an image with a pure black tone after exposure and heat development.

Another object of this invention is to provide a heat developable light-sensitive material having good original storability.

Still another object of this invention is to provide a heat developable light-sensitive material which does not seriously contaminate the developer machine.

It has now been found that the above objects of this invention can be achieved with a heat developable light-sensitive material comprising a support having thereon at least one light-sensitive layer containing (1) an oxidation-reduction image-forming combination comprising (a) a silver salt oxidizing agent and (b) a reducing agent and (2) a catalytic amount of a light-sensitive silver halide or a compound capable of reacting with the silver salt (a) to form a light-sensitive silver halide, with the light-sensitive layer further containing (3) at least one phthalazinone compound of the general formula (I)

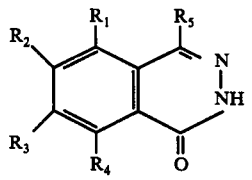

(I)

wherein $R_1$, $R_2$, $R_3$ and $R_4$ each represents a hydrogen atom, an alkyl group, an alkoxy group, a nitro group, an amino group or a hydroxyl group; $R_5$ represents a hydrogen atom, a halogen atom, an alkyl group, an aryl group, a substituted alkyl group, a substituted aryl group, a benzylidenehydrazino group, a pyridyl group, a vinyl group or a 2-substituted vinyl group; and all of $R_1$, $R_2$, $R_3$, $R_4$ and $R_5$ are not simultaneously a hydrogen atom; and a 2,3-dihydro-1,4-phthalazinedione compound of the general formula (II)

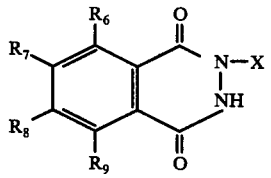

wherein $R_6$, $R_7$, $R_8$ and $R_9$ each represents a hydrogen atom, a halogen atom, a hydroxyl group, an alkyl group, an aryl group, an amino group, an alkylamino group, a nitro group, an alkoxy group, an alkylthio group or an acylamido group, and X represents a hydrogen atom, an aryl group, a pyridyl group, a 2-(2-pyridyl)-ethyl group, a 2-(4-pyridyl)ethyl group, a benzoyl group or a methyl group.

DETAILED DESCRIPTION OF THE INVENTION

In the above general formulae (I) and (II), preferred halogen atoms for $R_1$ to $R_4$ and $R_6$ to $R_9$ are, for example, chlorine and bromine atoms. Preferred alkyl groups for $R_1$ to $R_4$ and $R_6$ to $R_9$ are, for example, those alkyl groups containing 1 to 4 carbon atoms such as a methyl, ethyl, propyl, butyl or t-butyl group. Preferred alkoxy groups for $R_1$ to $R_4$ are, for example, those alkoxy groups containing 1 to 4 carbon atoms such as a methoxy, ethoxy, propoxy or butoxy group. Preferred aryl groups for $R_6$ to $R_9$ and X include, for example, a phenyl group and a naphthyl group. Preferred aminoalkyl groups for $R_6$ to $R_9$ are those containing 1 to 4 carbon atoms in the alkyl moiety such as a methyl, ethyl, propyl, isopropyl, butyl or t-butyl moiety. Preferred alkoxy groups for $R_6$ to $R_9$ are those alkoxy groups containing 1 to 4 carbons atoms such as a methoxy, ethoxy, propoxy, isopropoxy, butoxy or t-butoxy group. Preferred alkylthio groups for $R_6$ to $R_9$ are those alkylthio groups containing 1 to 18 carbon atoms such as a methylthio or benzylthio group. Preferred acylamido groups for $R_6$ to $R_9$ are those acylamido groups containing 1 to 4 carbon atoms in the acyl moiety such as an acetylamido, propionamido or butyrylamido group.

Preferred halogen atoms for $R_5$ are, for example, chlorine and bromine atoms. Preferred alkyl groups for $R_5$ are those containing 1 to 4 carbon atoms such as a methyl, ethyl, propyl or butyl group. Preferred alkoxy groups for $R_5$ are those containing 1 to 4 carbon atoms such as a methoxy, ethoxy, propoxy or butoxy group. Preferred aryl groups for $R_5$ are, for example, phenyl, 1-naphthyl and 2-naphthyl groups.

Examples of substituted alkyl groups for $R_5$ are haloalkyl groups containing 1 to 4 carbon atoms, such as a chloromethyl, bromoethyl, chloropropyl or chlorobutyl group; hydroxyalkyl groups such as a hydroxymethyl, $\beta$-hydroxyethyl, $\gamma$-hydroxypropyl or $\delta$-hydroxybutyl group; aminoalkyl groups containing 1 to 4 carbon atoms such as an aminomethyl, aminoethyl or aminobutyl group; N-alkylaminoalkyl groups or N,N-dialkylaminoalkyl groups of 1 to 4 atoms in which each alkyl moiety on the amino group also contains 1 to 4 carbon atoms such as a dimethylaminomethyl or dimethylaminoethyl group; aralkyl groups having 1 to 4 carbon atoms in the alkyl moiety thereof such as a benzyl or phenethyl group; alkoxyarylalkyl groups having 1 to 4 carbon atoms in the alkyl moiety thereof and also 1 to 4 carbon atoms in the alkoxy moiety thereof such as a p-methoxybenzyl group; and alkyl groups containing 1 to 4 carbon atoms substituted with a morpholino group such as a morpholinomethyl, morpholinoethyl, morpholinopropyl or morpholinobutyl group. Examples of substituted aryl groups for $R_5$ are phenyl groups substituted with an alkyl group of 1 to 4 carbon atoms such as a methylphenyl, ethylphenyl, butylphenyl or t-butylphenyl group; halophenyl groups such as a chlorophenyl or bromophenyl group; an aminophenyl group; and phenyl groups containing an amino group substituted with an alkyl group containing 1 to 4 carbon atoms such as a dimethylaminophenyl group. Examples of the 2-substituted vinyl groups for $R_5$ are $\beta$-styryl, 2-(3-pyridyl)vinylidene and 2-(2-pyridyl)vinylidene groups.

Specific examples of the compounds of the above general formula (I) are described below.

I-1. 4-Methylphthalazinone
I-2. 4-Phenylphthalazinone
I-3. 4-(1-Naphthyl)phthalazinone
I-4. 4-(2-Naphthyl)phthalazinone
I-5. 4-Hydroxymethylphthalazinone
I-6. 4-Chlorophthalazinone
I-7. 4-(p-Chlorophenyl)phthalazinone
I-8. 4-(p-Pyridino)phthalazinone
I-9. 4-Methoxyphthalazinone
I-10. 4-$\beta$-Styrylphthalazinone
I-11. 4-Dimethylaminomethylphthalazinone
I-12. 4-Morpholinomethylphthalazinone
I-13. 4-(p-Methoxybenzyl)phthalazinone
I-14. 4-(Benzylidenehydrazino)phthalazinone
I-15. 4-(p-Dimethylaminophenyl)phthalazinone
I-16. 4-Benzylphthalazinone
I-17. 6-Chlorophthalazinone
I-18. 5,7-Dimethoxyphthalazinone
I-19. 8-Methylphthalazinone
I-20. 6-Bromophthalazinone
I-21. 8-t-Butylphthalazinone
I-22. 5-Nitrophthalazinone
I-23. 8-Aminophthalazinone
I-24. 8-Hydroxyphthalazinone Of these compounds of the general formula (I), phthalazinones substituted with a naphthyl group at the 4-position, such as Compounds 3 and 4, and halogen-substitution products such as 6-chlorophthalazinone or 6-bromophthalazinone are preferred because they are especially suitable for obtaining heat developable light-sensitive materials which provide images of a pure black tone, do not cause any serious contamination of the developer machine, and have superior storability in the raw state.

Specific examples of the compounds expressed by the above general formula (II) are shown below.

II-1. 2,3-Dihydro-1,4-phthalazinedione
II-2. 5-Chloro-2,3-dihydro-1,4-phthalazinedione
II-3. 5-Bromo-2,3-dihydro-1,4-phthalazinedione
II-4. 2,3-Dihydro-6-hydroxy-1,4-phthalazinedione
II-5. 2,3-Dihydro-5-hydroxy-1,4-phthalazinedione
II-6. 5-Amino-2,3-dihydro-1,4-phthalazinedione
II-7. 5-Acetamido-2,3-dihydro-1,4-phthalazinedione
II-8. 6-Amino-2,3-dihydro-1,4-phthalazinedione
II-9. 2,3-Dihydro-2-phenyl-1,4-phthalazinedione
II-10. 2,3-Dihydro-2-(1-naphthyl)-1,4-phthalazinedione
II-11. 2,3-Dihydro-2-(2-naphthyl)-1,4-phthalazinedione
II-12. 2,3-Dihydro-5-nitro-1,4-phthalazinedione
II-13. 2,3-Dihydro-2-[2-(2-pyridyl)ethyl]-1,4-phthalazinedione
II-14. 2,3-Dihydro-2-[2-(4-pyridyl)ethyl]-1,4-phthalazinedione
II-15. 5-(Dimethylamino)-2,3-dihydro-1,4-phthalazinedione
II-16. 2,3-Dihydro-2-(2-pyridyl)-1,4-phthalazinedione
II-17. 2-Benzoyl-2,3-dihydro-1,4-phthalazinedione
II-18. 2,3-Dihydro-2-methyl-1,4-phthalazinedione
II-19. 2,3-Dihydro-5-methyl-1,4-phthalazinedione
II-20. 2,3-Dihydro-6-methyl-1,4-phthalazinedione
II-21. 2,3-Dihydro-5-phenyl-1,4-phthalazinedione
II-22. 2,3-Dihydro-6-phenyl-1,4-phthalazinedione
II-23. 5-Bromo-2,3-dihydro-8-methoxy-1,4-phthalazinedione
II-24. 6-Benzoyl-2,3-dihydro-1,4-phthalazinedione
II-25. 5,6,7,8-Tetraethyl-2,3-dihydro-1,4-phthalazinedione An effective amount of the Component (3) used in the heat developable light-sensitive material of this invention is generally about 0.01 mol to 10 mols of the compounds of the general formula (I) and about 0.002 mol to 10 mols of the compounds of the general formula (II) per mol of the silver salt oxidizing agent (a). An especially preferred amount of 0.05 mol to 2 mols of the compounds of the general formula (I) and 0.005 mol to 0.5 mol of the compounds of the general formula (II)

per mol of the silver salt oxidizing agent (a). Suitable amounts, however, differ depending upon not only the type of the Component (3), but also the types of the silver salt oxidizing agent (a), the reducing agent (b) and the silver halide (2) and the processing conditions. If the amount is larger than about 10 mols of the compounds of the general formulas (I) and (II) per mol of the silver salt oxidizing agent (a), heat development tends to be inhibited, and the maximum density of the image decreases. Furthermore, the light stability of the light-sensitive material after processing is sometimes reduced. On the other hand, if the amount of the Component (3) is less than about 0.01 mol of the compounds of the general formula (I) or about 0.002 mol of the compounds of the general formula (II) per mol of the silver salt oxidizing agent (a), the resulting image tends to become brownish, and the desired black image cannot be obtained.

Examples of suitable silver salt oxidizing agents (a) are silver salts of aliphatic carboxylic acids, aromatic carboxylic acids, or organic compounds containing an imino or mercapto group. These silver salts are oxidizing agents which are relatively stable to light and form silver images by an oxidation-reduction reaction with a reducing agent due to the catalytic action of the silver halide in the exposed portion when the light-sensitive material is heated. Specific examples of such silver salt oxidizing agents are described in detail below.

(1) Aliphatic carboxylic acid silver salts

Silver caprate, silver laurate, silver myristate, silver palmitate, silver stearate, silver behenate, silver maleate, silver fumarate, silver sebacate, silver tartrate, silver adipate, silver linolate, etc.

(2) Aromatic carboxylic acid silver salts

Silver benzoate, silver 3,5-dihydroxybenzoate, silver o-methylbenzoate, silver m-methylbenzoate, silver p-methylbenzoate, silver 2,4-dichlorobenzoate, silver gallate, silver tannate, silver phthalate, silver terephthalate, silver salicylate, etc.

(3) Silver salts of organic compounds containing an imino group

Silver saccharin, silver benzotriazole, silver phthalazinone, silver substituted phthalazinone, and the silver salt of 4-hydroxy-6-methyl-1,3,3*a*,7-tetrazaindene.

(4) Silver salts of organic compounds containing a mercapto group

3-Mercapto-4-phenyl-1,2,4-triazole silver salt, 2-mercaptobenzoimidazole silver salt, 2-mercapto-5-aminothiazole silver salt, 1-phenyl-5-mercaptotetrazole silver salt, 2-mercaptobenzothiazole silver salt, 2-(s-ethylthioglycolic amide)benzothiazole silver salt, etc.

The reducing agent used as Component (b) in this invention is an organic reducing agent which has a reducing ability suitable for forming a silver image as a result of reducing the silver salt oxidizing agent upon heating due to the catalytic action of the silver halide present in the exposed area. The reducing agent can be chosen from the following compounds depending on the specific silver salt oxidizing (a) with which it is combined.

1. Monohydroxybenzenes,
2. Dihydroxybiphenyls,
3. Di- and poly-hydroxybenzenes,
4. Naphthols, naphthylamines and aminonaphthols,
5. Hydroxybinaphthyls,
6. Aminophenols,
7. p-Phenylenediamines,
8. Alkylene bisphenols,
9. Ascorbic acid and its derivatives, and
10. Pyrazolidones.

Specific examples of these compounds are described below.

(1) Monohydroxybenzenes p-Phenylphenol, o-phenylphenol, p-ethylphenol, p-t-butylphenol, p-sec-butylphenol, p-t-amylphenol, p-methoxyphenol, p-ethoxyphenol, p-cresol, 2,6-di-t-butyl-p-cresol, 2,4-xylenol, 2,6-xylenol, 3,4-xylenol, p-acetylphenol, 1,4-dimethoxyphenol, 2,6-dimethoxyphenol, hydroquinone mono-n-hexyl ether, hydroquinone monobenzyl ether, chlorothymol, etc.

(2) Dihydroxybiphenyls 3,3',5,5,'-tetra-t-butyl-4,4'-dihydroxybenzene, etc.

(3) Di- and poly-hydroxybenzenes

Hydroquinone, methylhydroquinone, t-butylhydroquinone, 2,5-dimethylhydroquinone, 2,6-dimethylhydroquinone, t-octylhydroquinone, phenylhydroquinone, methoxyhydroquinone, ethoxyhydroquinone, chlorohydroquinone, bromohydroquinone, hydroquinonemonosulfonate, catechol, 3-cyclohexylcatechol, resorcinol, gallic acid, methyl gallate, n-propyl gallate, etc.

(4) Naphthols, naphthylamines and aminophthols

α-Naphthol, β-naphthol, 1-hydroxy-4-methoxynaphthalene, 1-hydroxy-4-ethoxynaphthalene, 1,4-dihydroxynaphthalene, 1,5-dihydroxynaphthalene, 1-hydroxy-2-phenyl-4-methoxynaphthalene, 9-hydroxy-2-methyl-4-methoxynaphthalene, potassium 1-amino-2-naphthol-6-sulfonate, 1-hydroxy-4-aminonaphthalene, 1-naphthylamine-7-sulfonic acid.

(5) Hydroxybinaphthyls 1,1'-Dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, etc.

(6) Aminophenols p-Aminophenol, o-aminophenol, 2,4-diaminophenol, N-methyl-p-aminophenol, 2-methoxy-4-aminophenol, 2-β-hydroxyethyl-4-aminophenol, etc.

(7) p-Phenylenediamines

N,N'-Diethyl-p-phenylenediamine, N,N'-dibenzylidene-γ-phenylenediamine, etc.

(8) Alkylenebisphenols 1,1-bis-(2-hydroxy-3-t-butyl-5-methylphenyl)-methane, 1,1-bis-(2-hydroxy-3,5-dimethylphenyl)-3,5,5-trimethylhexane, 1,1-bis-(2-hydroxy-3,5-di-t-butylphenyl)-2-methylpropane, 2,2-bis-(4-hydroxy-3-methylphenyl)-propane, 4,4-bis-(4-hydroxy-3-methylphenyl)-heptane, 2,2-bis-(4-hydroxy-3-isopropylphenyl)-propane, 2,2-bis-(4-hydroxy-3-phenylphenyl)-propane, 1,1-bis-(4-hydroxy-3-methylphenyl)cyclohexane, 2,2-bis-(4-hydroxy-3,5-dimethylphenyl)-propane, 2,2-bis-(4-hydroxy-3-t-butyl-5-methylphenyl)-propane, 3,3-bis-(4-hydroxy-3-t-dodecylphenyl)hexane, (4,4'-di-hydroxy-3-methyldiphenyl)-2,2-propane, (4,4'-dihydroxy-3-t-octyldiphenyl)-2,2-propane, (4,4'-dihydroxy-3-t-butyldiphenyl)-4-methyl-2,2-pentane, (4,4'-dihydroxy-3-methyl-3'-t-butyldiphenyl)-2,2-propane, (4,4'-dihydroxy-3-methyl-5-t-butyldiphenyl)-2,2-propane, 2,2-bis-(4-hydroxyphenyl)propane, (4,4'-dihydroxy-3,3',5-trimethyldiphenyl)-3,3-pentane, N-(4-hydroxyphenyl)-salicylamine, 2,2-bis-(3,5-dibromo-4-hydroxyphenyl)-propane, bis-(3-methyl-4-hydroxy-5-t-butylphenyl)-sulfite, etc.

(9) Ascorbic acid and its derivatives

*l*-ascorbic acid, esters such as ethyl *l*-ascorbate, diesters such as diethyl *l*-ascorbate, etc.

(10) Pyrazolidones

1-Phenyl-3-pyrazolidone, 4-methyl-4-hydroxymethyl-1-phenyl-3-pyrazolidone, etc.

These reducing agents (b) can be used individually or as a combination of two or more. The reducing agents which are suitable greatly depend on the reducibility of the silver salt oxidizing agent (a) used. For example, for difficultly-reducible silver salts such as silver benzotriazole, ascorbic acids having a strong reducing ability are suitable as a reducing agent. For silver salts of higher fatty acids, reducing agents having an increasingly higher reducing ability must be used as the number of the carbon atoms of the silver salt increases. For example, a relatively weak reducing agent such as p-phenylphenol is suitable for silver laurate, but for silver behenate, a relatively strong reducing agent such as 1,1'-bis-(2-hydroxy-3-t-butyl-5-methylphenyl)methane is suitable.

The effective amount of the reducing agent cannot be unequivocally set forth since the amount varies with the oxidation-reduction combination of (a) and (b). Usually, however, a suitable amount is about 0.1 to 5 mols per mol of the silver salt oxidizing agent (a).

The light-sensitive silver halide used in a catalytic amount as Component (2) in this invention includes silver chloride, silver bromide, silver bromoiodide, silver chlorobromoiodide, silver chlorobromide, silver iodide, or a mixture of these silver halides. The silver halide can be used in the form of coarse particles or fine particles, but the use of very fine particles of the silver halide is especially preferred. An emulsion containing the light-sensitive silver halide can be prepared using any desired method known in the light-sensitive art, and examples of emulsions which are suitable are a single jet emulsion, a double jet emulsion, Lipmann emulsion, an ammonia method emulsion, a thiocyanate or thioether ripened emulsion, or the emulsions as described in U.S. Pat. Nos. 2,222,264, 3,320,069, and 3,271,157.

The silver halide used in the performance of the present invention can be sensitized using chemical sensitizers, such as a reducing agent, sulfur, a selenium compound, gold, platinum, or a palladium compound, or a combination of these methods. Suitable methods of sensitization are disclosed, for example, in U.S. Pat. Nos. 2,623,499, 2,399,083, 3,297,147, and 3,297,446

The catalytic amount of the light-sensitive silver halide can be prepared separately, and used as one component of the light-sensitive layer used in this invention. Preferably however, a halogen-containing compound is present as a component for forming a catalytic amount of the light-sensitive silver halide during the formation of an organic silver salt (a) which is a component of the light-sensitive layer used in this invention, whereby the light-sensitive silver halide (2) is formed simultaneously with the formation of the organic silver salt (a). Alternatively, a halogen-containing compound is reacted with the organic silver salt to form a catalytic amount of silver halide in a portion of the organic silver salt (a). For example, this can be accomplished simply by adding a solution of a halogen-containing compound such as ammonium bromide to a polymer dispersion of silver laurate. Examination of the variations in the X-ray diffraction pattern, for example, shows that a part of the silver laurate reacts with the ammonium bromide to form silver bromide.

Suitable halogen-containing compounds that can be used in this invention are inorganic halogen compounds, for example, compounds expressed by the formula $MX'_n$ in which M represents a hydrogen atom, an ammonium group or a metal atom, X' represents a halogen atom, and $n$ is 1 when M is a hydrogen atom or an ammonium group and represents the valency of the metal atom when M is a metal atom. Specific examples include hydrogen halides, ammonium halides, and halides of metals such as strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, indium, rhodium, ruthenium, palladium, iridium, platinum. thallium, and bismuth. The halides can be chlorides, bromides, iodides, and mixtures of these halides.

Other examples of the halogen-containing compounds that can also be used in this invention are organic halogen compounds such as triphenylmethyl chloride, triphenylmethyl bromide, 2-bromo-2-methylpropane, 2-bromobutyric acid, 2-bromoethanol, anddichlorobenzophenone, halogenated hydrocarbons such as iodoform, bromoform and carbon tetrabromide, N-haloacetamides and N-halosuccinimides such as N-bromoacetamide, N-bromosuccinimide, etc., and onium halides such as cetyl ethyl dimethyl ammonium bromide.

A suitable amount of such a light-sensitive silver halide or halogen-containing compound as a component of forming the silver halide (2) is about 0.001 mol to 0.5 mol per mol of the organic silver salt (a). If the amount is smaller than about 0.001 mol per mol of the organic silver salt (a), the sensitivity of the light-sensitive material is reduced, and if the amount is larger than about 0.5 mole per mol of the organic silver salt (a), the amount of the silver halide increases. Since silver halide has the property of gradually blackening on exposure to normal room illumination, when the heat-developed material is allowed to stand under normal room illumination, the non-image portion will gradually blacken. This in turn may cause an impairment in the contrast between the image portion and the non-image portion.

A binder can be incorporated in the heat developable material composition used in this invention. Suitable binders are usually hydrophobic, but can also be hydrophilic. These binders are transparent or semi-transparent, and include, for example, natural substances such as gelatin, gelatin derivatives or cellulose derivatives, and synthetic polymers such as polyvinyl compounds or acrylamide polymers. Other suitable synthetic polymer compounds include dispersed vinyl compounds of the latex type. Preferred high-molecular-weight compounds and resins include, for example, polyvinyl butyral, cellulose acetate butyrate, trimethyl methacrylate, polyvinyl pyrrolidone, ethyl cellulose, polystyrene, polyvinyl chloride, chlorinated rubber, polyisobutylene, a butadiene/styrene copolymer, a vinyl chloride/vinyl acetate copolymer, a vinyl chloride/vinyl acetate/maleic acid copolymer, and polyvinyl alcohol.

An amount of the binder usually employed ranges from about 10:1 to 1:5, preferably from 4:1 to 1:4, in terms of a weight ratio of the binder to the organic silver salt (a).

In order to inhibit the occurrence of heat fog which is the phenomenon whereby the unexposed area turns black upon heat development of the light-sensitive material, it is preferred to add an anti-heat fogging agent.

Suitable antifoggants for this purpose are, for example, the palladium and platinum compounds disclosed in U.S. Pat. No. 2,566,263, the mercury salts and nitroindazole disclosed in U.S. Pat. No. 2,728,663, the polyvalent metal salts such as cadmium chlorides disclosed in U.S. Pat. No. 2,839,405, and the N-halo compounds disclosed in German OLS No. 2,326,865 and Japanese Patent Application Nos. 8194/73, and 2842/73, for example, N-halosuccinimides such as N-bromosuccinimide, and N-haloacetamides such as N-bromoacetamide. These anti-foggants can be used either individually or in combination.

The support used in this invention can be selected from a wide variety of supports. Typical supports are, for example, a cellulose nitrate film, a cellulose ester film, a polyvinyl acetal film, a polystyrene film, a polyethylene terephthalate film, a polycarbonate film, other resinous substances, a glass sheet, paper, or metal sheets. When a paper is used as a support, a clay or a styrene/-butadiene rubber, etc. is preferably incorporated in the paper.

An antistatic layer or an electrically conducting layer can be provided in the heat developable light-sensitive material of this invention if desired. An anti-halation substance or anti-halation dye can also be incorporated in the heat developable light-sensitive material of this invention, if desired.

If desired, a matting agent such as kaolin, starch, titanium dioxide, zinc oxide or silica can be incorporated in a top-coated layer polymer or a light-sensitive layer in the heat developable light-sensitive material of this invention. It is also possible to incorporate a fluorescent brightening agent, such as a stilbene, a triazine, an oxazole or a coumarin in the heat developable light-sensitive material of this invention.

In order to increase the transparency of the heat developable light-sensitive layer, increase the density of the image, improve the storability of the light-sensitive material in the original state and if desired, enhance the thermal stability of the film, a polymer top-coat layer can be provided on the light-sensitive layer. The thickness of the topcoat polymer layer is suitably about 1 to 20 microns. If the thickness is less than about 1 micron, the above effect is lost, and on the other hand, if the polymer overcoat layer is too thick, no particular advantage is gained, and the cost becomes high. Suitable polymers for the topcoat layer are those which are heat resistant, colorless and soluble in solvents. Examples of suitable polymers are polyvinyl chloride, polyvinyl acetate, a copolymer of vinyl chloride and vinyl acetate (preferably, one containing at least 50 mol% of vinyl chloride), polyvinyl butyral, polystyrene, poly(methyl methacrylate), benzyl cellulose, ethyl cellulose, cellulose acetate butyrate, cellulose diacetate, cellulose triacetate, polyvinylidene chloride, chlorinated polypropylene, polyvinyl pyrrolidone, cellulose propionate, polyvinyl formal, cellulose acetate phthalate, polycarbonate, cellulose acetate propionate, gelatin, gelatin derivatives such as phthalic-modified gelatin, an acrylamide polymer, polyisobutylene, a copolymer of butadiene and styrene (at optional monomer ratios), and polyvinyl alcohol. Preferred polymers have a heat resistance of at least about 115° F and a refractive index at 20° C of at leat about 1.45.

The heat developable light-sensitive layer and the top-coated layer of the light-sensitive material of this invention can be provided using various coating methods such as an immersion method, an air knife method, a curtain coating method, and an extrusion-coating method using a hopper of the type disclosed in U.S. Pat. No. 2,681,294. If desired, two or more layers composed of the light-sensitive layer and the top-coated layer can be coated at the same time.

The spectral sensitivity of the light-sensitive layer can be changed by adding a suitable amount of an appropriate light-sensitive spectral sensitizing dye. Usually, light-sensitive materials containing a light-sensitive silver halide as a catalyst are sensitive only to light in the near ultraviolet range to the blue range of actinic rays. The addition of a spectral sensitizing dye makes it possible to render the silver halide sensitive also to light of longer wavelength.

Examples of such dyes are cyanine and merocyanine dyes in which a simple methine chain is interposed between fused rings of a heterocyclic or benzenoid type, xanthene dyes such as rhodamines or eosines, aridine dyes such as methylene blue and thionine, and styryl dyes.

Specific examples of these dyes include those described in German Patent OLS No. 2,328,868, Japanese Patent Publication Nos. 127,999/72, 14916/73, 7624/73, 12587/73, and 50903/73, and U.S. Pat. Nos. 3,719,495 and 3,761,279. These sensitizing dyes can be used in the form of a solution or dispersion in an organic solvent. An effective amount of the dye is about $10^{-6}$ to about $10^{-2}$ mol per of the silver salt oxidizing agent (a) above.

The heat developable light-sensitive material of this invention can be developed by merely heating it after it has been exposed imagewise, e.g., for about 0.01 to 60 seconds, preferably 0.1 to 30 seconds, using an ordinary light source such as a photographic flash light source, a xenon lamp, a tungsten lamp, a mercury lamp or a copying fluorescent lamp. A suitable developing temperature ranges from about 90° to 180° C, preferably 100° to 170° C. The developing time depends upon the heating temperature employed. Generally, the appropriate developing time decreases when the development is performed at higher temperatures. Usually, however, images of good quality can be obtained in 1 to 60 seconds.

Heating can be performed in various ways. For example, the exposed light-sensitive material can be brought into contact with a simple heated plate or a heated drum. Alternatively, the material can be passed through a heated space. Further high frequency inductive heating can be used. If desired, the light-sensitive material may be heated at 30° to 140° C, preferably 50° to 140° C, and at the same time, exposed imagewise. Alternatively, the light-sensitive material can be exposed imagewise after being pre-heated to 30° to 160° C, preferably 50° to 140° C.

The heat developable light-sensitive material in accordance with this invention provides images with a favorable black tone, and has good storability in the raw state. The amount of the toning agent used in this invention can be smaller than the amount of known toning agents employed and a desirable black color tone still be obtained. During the heat development of the light-sensitive material of this invention, the amount of the toning agent that volatilizes is small, and therefore, contamination of the developer machine does not occur.

The following Examples illustrate the present invention in greater detail. Unless otherwise specified, all percentages are by weight.

EXAMPLE 1

One liter of an aqueous solution of 20 g of sodium hydroxide was mixed with 2 liters of toluene having dissolved therein 120 g of lauric acid, and the mixture was emulsified using a high speed rotary stirrer. To the emulsion, 500 ml of a 0.4% by weight aqueous solution of hydrobromic acid was added, and the mixture was again emulsified. To the resulting emulsion, 500 ml. of an aqueous solution of 85 g of silver nitrate was added to form silver laurate and silver bromide simultaneously. The toluene phase containing the silver nitrate and the silver bromide was separated from the aqueous phase, and dispersed in 2.4 Kg of a 15% by weight isopropanol solution of polyvinyl butyral using a high speed rotary stirrer. The resulting dispersion will be referred to hereinafter as a silver salt polymer dispersion.

To 200 g of the silver salt polymer dispersion were added 30 cc of a 0.025% methanol solution of 2', 7'-dichlorofluorescein as a sensitizing dye, 10 cc of a 1% methanol solution of mercuric acetate as an anti-heat fogging agent, 10 cc of a 3% dimethyl formamide solution of 4-(1-naphthyl)phthalazinone (Compound I-3), and 60 cc of a 10% acetone solution of p-ethoxyphenol to form a heat developable light-sensitive coating solution. The solution was coated on a support (art paper) so that the amount of silver coated was 0.6 g/m$^2$, and dried to prepare a heat developable light-sensitive Material (A).

Separately, for comparison, a heat developable light-sensitive Material (B) and a heat developable light-sensitive Material (C) were prepared in the same way as described above except that Compound I-3 was not added, and 100 cc of a 3% methanol solution of phthalazinone was added instead of Compound I-3, respectively.

Each of these three light-sensitive materials was exposed through an original having gradation using a tungsten-filament lamp, and then heated at 140° C for 10 seconds. An image of a black tone was formed in Material (A), but in Material (B), the resulting image was yellowish brown. Material (C) had a color tone similar to that of Material (A). But when Materials (A) and (C) were each subjected to the same evaluation after having been allowed to stand for 3 months in a dark place at 25° C, the color tone of Material (C) turned brown, whereas Material (A) still provided an image of a black tone. This demonstrates that Compound I-3 is a toning agent having superior storability in the original state as compared with phthalazinone.

Each of Materials (A) and (C) was heat developed by being passed between a silicone rubber roller and a heated shoe in contact therewith. When both of Materials (A) and (C) were processed in great quantities in almost the same amount, i.e., equal levels of toning agent coated, a great amount of the toning agent was seen to adhere to the metal portion near the heated portion for Material (C), but no such contamination was observed at all for Material (A). This fact clearly demonstrates that the use of Compound I-3 provides a superior light-sensitive material which does not contaminate the heating device.

EXAMPLE 2

Behenic acid (3.4 g) was dissolved in 100 ml of toluene at 60° C, and while maintaining the solution at 60° C and stirring the solution with a high speed rotary stirrer, 100 ml of a dilute aqueous solution of nitric acid whose pH had been adjusted to 2.0 (25° C) with nitric acid was mixed with the behenic acid solution.

Aqueous ammonia was added to 80 ml of an aqueous solution containing 1.7 g of silver nitrate to form a silver-ammonium complex salt, and water was added to form 100 ml of an aqueous solution. With stirring, this aqueous solution was added to the mixed solution prepared above.

The resulting dispersion of fine crystals of silver behenate was allowed to stand for 20 minutes at room temperature (about 20° to 30° C), whereupon the solution separated into an aqueous phase and an oil phase. The oil phase was separated by decantation, washed with water, and centrifuged to separate the silver behenate. Spindle-shaped fine crystals of silver behenate each measuring about 1 micron in length and about 0.05 micron in width were obtained in an amount of 4 g. The resulting silver behenate was added in an amount of 2.5 g to 20 ml of an isopropyl alcohol solution containing 2 g of polyvinyl butyral, and the mixture was ball milled for 2 hours to form a polymer dispersion. To the resulting dispersion were added 1 cc of a solution of 2% by weight of a saturated (50 %) aqueous solution of hydrogen bromide in methanol, 5 cc of a 0.0025% methanol solution of tetrachlorotetrabromofluoroscein as a sensitizing dye, 3 cc of a 3% dimethylformamide solution of 4-(1-naphthyl)phthalazinone (Compound I-3), and 7.5 cc of a 20% acetone solution of 2,2'-methylenebis(6-t-butyl-4-methylphenol) to form a heat developable light-sensitive coating solution. The resulting coating solution was coated on a polyethylene terephthalate film support so that the amount of silver coated was 1.5 g/m$^2$ to prepare a heat developable light-sensitive material. When this light-sensitive material was subjected to the same evaluation as in Example 1, a good image of a black tone was obtained.

EXAMPLE 3

Example 2 was repeated except that 4-(p-methoxybenzyl)-phthalazinone (Compound I-13) was used instead of Compound I-3. A good image of a black tone was obtained.

EXAMPLE 4

To 200 g of the silver salt polymer dispersion obtained in Example 1 were added 30 cc of a 0.025% methanol solution of 2', 7'-dichloroflurescein as a sensitizing dye, 10 cc of a 1% acetic acid-acidified methanol solution of mercuric acetate as an antiheat fogging agent, 40 cc of a 1.8% dimethylformamide solution of 6-chlorophthalazinone (Compound I-17) and 60 cc of a 10% acetone solution of p-ethoxyphenol to form a heat developable light-sensitive coating solution. The resulting coating solution was coated on a support(art paper) so that the amount of silver coated was 0.6 g/m$^2$, and dried to prepare a heat developable light-sensitive Material (A).

Separately, for comparison, a heat developable light-sensitive Material (B) and a heat developable light-sensitive Material (C) were prepared in the same way as described above except that Compound 17 was not added, and 100 cc of a 3% methanol solution of phthalazinone was added instead of Compound I-17, respectively.

Each of these three light-sensitive materials was exposed through an original having gradation using a tungsten-filament lamp, and then heated at 140° C for 10 seconds. In Material (A), an image of a black tone was obtained, but in Material (B), the resulting image was yellowish orange. Material (C) had a color tone similar to that of Material (A). When Materials (A) and (C) were each allowed to stand for 3 months in a dark place at 25° C and then again subjected to the above-mentioned evaluation, the color tone of Material (C) became brown, whereas Material (A) still provided an image of a black tone. This shows that Compound I-17 is a color toning agent having superior storability in the original state as compared with phthalazinone.

Each of Materials (A) and (C) was heat developed by passage between a silicone rubber roller and a heated shoe in contact therewith. When both of Materials (A) and (C) were processed in great quantities in portions of almost the same area, a great amount of the toning agent was seen to adhere to the metal portion near the heated portion with Material (C), but such a contamination was not all observed for Material (A). It is clear from this that by using Compound I-17, a light-sensitive material from which the toning agent is scarcely volatilized can be obtained, thus obviating the tendency towards contamination of the heating device.

EXAMPLE 5

Behenic acid (3.4 g) was dissolved in 100 ml of toluene at 60° C, and while maintaining the solution at 60° C and stirring the behenic acid solution with a high speed rotary stirrer, 100 ml of a dilute aqueous solution of nitric acid whose pH had been adjusted to 2.0 (25° C) with nitric acid was mixed with the above solution. Aqueous ammonia was added to 80 ml of an aqueous solution containing 1.7 g of silver nitrate to form a silver-ammonium complex salt, and water was added to form 100 ml of an aqueous solution. With stirring, this aqueous solution was added to the mixed solution prepared above. The resulting dispersion of fine crystals of silver behenate was allowed to stand for 20 minutes at room temperature, whereupon the dispersion separated into an aqueous phase and an oil phase. The oil phase was separated by decantation, washed with water, and centrifuged to separate the silver behenate. Spindle-shaped silver behenate crystals each measuring about 1 micron in length and 0.05 micron in width were obtained in an amount of 4 g.

The resulting silver behenate was added in an amount of 2.5 g to 20 ml of an isopropyl alcohol solution containing 2 g of polyvinyl butyral, and the mixture was ball milled for 2 hours to form a polymer dispersion. To the resulting dispersion were added 1 cc of a solution of 2% by weight of a saturated (50%) aqueous solution of hydrogen bromide in methanol, 5 cc of a 0.0025% methanol solution of a tetrachlorotetrabromofluorescein as a sensitizing dye, 30 cc of a 0.8% ethanol/water (80:20 by volume) solution of 8-methylphthalazinone (Compound I-19)and 7.5 cc of a 20% acetone solution of 2,2'-methylenebis(6-t-butyl-4-methylphenol) to form a heat developable light-sensitive coating solution. The resulting coating solution was coated on a polyethylene terephthalate film support so that the amount of silver coated was 1.5 g/m$^2$ to prepare a heat developable light-sensitive materal.

When this light-sensitive material was subjected to the same evaluation as in Example 1, a good image of a black tone was obtained.

EXAMPLE 6

To 200 g of a silver salt polymer dispersion obtained as described in Example 1 were added 30 cc of a 0.025% methyl Cellosolve solution of 3-allyl-5-[(3-ethyl-2(3H)-naphtho-[2,1]-oxazolylidene)ethylidene]-1-phenyl-2-thiohydantoin as a sensitizing dye, 10 cc of a 1% acetic acid-acidified methanol solution of mercuric acetate as an anti-heat fogging agent, 80 cc of a 1% dimethylformamide solution of 5,7-dimethoxyphthalazinone (Compound I-18) and 50 cc of a 20% acetone solution of 2,2-bis(3,5-dimethyl-4-hydroxyphenyl)propane as a reducing agent to form a heat developable light-sensitive coating solution. The resulting coating solution was coated on an art paper support so that the amount of silver coated was 0.6 g/m$^2$, and dried to prepare a heat developable light-sensitive Material (D).

For comparison, Materials (B) and (C) obtained in Example 1 and the above Material (D) were each exposed through a transparent line original using a tungstem-filament lamp as a light source, and then heated at 120° C for 20 seconds.

In material (D), an image of a black tone was obtained, but in material (B) the resulting image was yellowish brown in tone and thus extremely undesirable.

Material (C) provided the same color tone as Material (D) immediately after preparation. However after the materials were allowed to stand for a long period of time, Material (C) provided only a brown image, whereas Material (D) still provided a black image.

These samples were subjected to the same heat development evaluation using a heated shoe. It was found that Material (D) caused less contamination of the heating device than Material (C). Thus, it is clear that a heat developable light-sensitive material which does not contaminate the heating machine can be obtained by using Compound I-18.

EXAMPLE 7

One liter of an aqueous solution of 20 g of sodium hydroxide was mixed with 2 liters of toluene having dissolved therein 120 g of lauric acid, and the mixture was emulsified using a high speed rotary stirrer. To the emulsion, 500 ml of a 0.4% by weight aqueous solution of hydrobromic acid was added, and the mixture was again emulsified. To the resulting emulsion, 500 ml of an aqueous solution of 85 g of silver nitrate was added to form silver laurate and silver bromide simultaneously. The toluene phase containing the silver nitrate and the silver bromide was separated from the aqueous phase, and dispersed in 2.4 Kg of a 15% by weight isopropanol solution of polyvinyl butyral using a high speed rotary stirrer.

To 200 g of the silver salt polymer dispersion were added 30 cc of a 0.025% methanol solution of 2', 7'-dichlorofluorescein as a sensitizing dye, 10 cc of a 1% methanol solution of mercuric acetate as an anti-heat fogging agent, 150 g of 2,3-dihydro-1,4-phthalazinedione (Compound II-1), and 60 cc of a 10% acetone solution of p-ethoxy phenol to form a heat developable light-sensitive coating solution. The solution was coated on a support (art paper) so that the amount of silver coated was 0.6 g/m$^2$, and dried to prepare a heat developable light-sensitive Material (A).

Separately, for comparison, a heat developable light-sensitive Material (B) and a heat developable light-sensitive Material (C) were prepared in the same way as described above except that Compound II-1 was not added, and 100 cc of a 3% methanol solution of phthalazinone was added instead of Compound II-1, respectively.

Each of these three light-sensitive materials was exposed through an original having gradation using a tungsten-filament lamp, and then heated at 140° C for 10 seconds. An image of a black tone was formed in Material (A), but in Material (B), the resulting image was yellowish brown. Material (C) had a color tone similar to that of Material (A). But when Materials (A) and (C) were each subjected to the same evaluation after having been allowed to stand for 3 months in a dark place at 25° C, the color tone of Material (C) turned brown, whereas Material (A) still provided an image of a black tone. This demonstrates that the Compound II-1is a toning agent having superior storability in the original state as compared with phthalazinone.

Each of Materials (A) and (C) was heat developed by being passed between a silicone rubber roller and a heated shoe in contact therewith. When both of Materials (A) and (C) were processed in great quantities at portions of almost the same size, a great amount of the toning agent was seen to adhere to the metal portion near the heated portion for Material (C), but no such contamination was observed at all for Material (A). This fact clearly demonstrates that the use of the Compound II-1 provides a superior light-sensitive material which does not contaminate the heating device.

EXAMPLE 8

Behenic acid (3.4 g) was dissolved in 100 ml of toluene at 60° C, and while maintaining the solution at 60° C and stirring the solution with a high speed rotary stirrer, 100 ml of a dilute aqueous solution of nitric acid whose pH had been adjusted to 2.0 (25° C) with nitric acid was mixed with the behenic acid solution.

Aqueous ammonia was added to 80 ml of an aqueous solution containing 1.7 g of silver nitrate to form a silver-ammonium complex salt, and water was added to form 100 ml of an aqueous solution. With stirring, this aqueous solution was added to the mixed solution prepared above.

The resulting dispersion of fine crystals of silver behenate was allowed to stand for 20 minutes at room temperature (about 20° to 30° C), whereupon the solution was separated into an aqueous phase and an oil phase. The oil phase was separated by decantation, washed with water, and centrifuged to separate the silver behenate. Spindle-shaped fine crystals of silver behenate each measuring about 1 micron in length and about 0.05 micron in width were obtained in an amount of 4 g. The resulting silver behenate was added in an amount of 2.5 g to 20 ml of an isopropyl alcohol solution containing 2 g of polyvinyl butyral, and the mixture was ball milled for 2 hours to form a polymer dispersion. To the resulting dispersion were added 1 cc of a 2% methanol solution of aqueous hydrogen bromide, 5 cc of a 0.0025% methanol solution of tetrachlorotetrabromofluoroscein as a sensitizing dye, 3 cc of a 2% dimethylformamide solution of 5-chloro-2,3-dihydro-1,4-phthalazinedione (Compound II-2), and 7.5 cc of a 20% acetone solution of 2,2'-methylenebis(6-t-butyl-4methylphenol) to form a heat developable light-sensitive coating solution. The resulting coating solution was coated on a polyethylene terephthalate film support so that the amount of silver coated was 1.5 g/m$^2$ to prepare a heat developable light-sensitive material. When this light-sensitive material was subjected to the same evaluation as in Example 1, a good image of a black tone was obtained.

EXAMPLE 9

To 200 g of the silver salt polymer dispersion obtained in Example 7 were added 30 cc of a 0.025% methyl Cellosolve solution of 3-allyl-5[(3-ethyl-2(3H)-naphtho-[2,1]-oxazolylidene)ethylidene]-1-phenyl-2-thiohydantoin as a sensitizing dye, 10 cc of a 1% acetic acid-acidified methanol solution of mercuric acetate as an antiheat fogging agent, 40 cc of a 1.8% dimethylformamide solution of 2,3-dihydro-1,4-phthalazinedione (Compound II-1) and 60 cc of a 20% acetone solution of 2,2-bis(3,5-dimethyl-4-hydroxyphenyl)-propane to form a heat developable light-sensitive coating solution. The resulting coating solution was coated on a support (art paper) so that the amount of silver coated was 0.6 g/m$^2$, and dried to prepare a heat developable light-sensitive material.

The above light-sensitive material was exposed through a transparent line original in the same way as in Example 7 using a tungsten-filament lamp as a light source, and then heated at 120° C for 20 seconds. A good quality image with a black tone was obtained.

EXAMPLE 10

A solution obtained by dissolving 8.6 g of capric acid in 100 ml of butyl acetate was maintained at 5° C, and with good stirring, 50 ml of a 0.4% aqueous solution of hydrobromic acid was added and emulsified. To the resulting emulsion was added 50 ml of an aqueous solution of a silver ammonium complex salt containing 8.5 g of silver nitrate to form silver caprate and silver bromide simultaneously. The silver salts were separated, and washed, and then dispersed in 120 g of a 15% by weight aqueous solution of isopropyl alcohol. To the dispersion were added 20 cc of a 2.5% methanol solution of N-bromoacetamide as an anti-heat fogging agent, 60 cc of a 0.025% methanol solution of tetrachlorotetrabromofluorescein as a sensitizing dye, 300 mg of 2,3-dihydro-5-hydroxy-1,4-phthalazinedione (Compound II-5) and 100 cc of a 35% methyl Cellosolve solution of bisphenol A, and the mixture was stirred using a high speed rotary stirrer. The resulting coating solution was coated on a paper support so that the amount of the silver coated was 1.0 g/m$^2$, and dried to form a heat developable light-sensitive material.

The resulting heat developable light-sensitive material was exposed through a transparent original containing gradation using a tungsten-filament lamp as a light source, and then heated at 140° C for 8 seconds. A good quality image with a black tone was obtained.

EXAMPLE 11

Example 9 was repeated except that 2,3-dihydro-2-phenyl-1,4-phthalazinedione (Compound II-10) was used instead of Compound II-1. The resulting heat developable light-sensitive material was heat developed in the same way as in Example 9 to form a good quality image with a black tone.

While the invention has been described in detail and with reference to specific embodiments thereof, it will be apparent to one skilled in the art that various changes and modifications can be made therein without departing from the spirit and scope thereof.

What is claimed is:

1. A process for forming images, which comprises image-wise exposing a light-sensitive material comprising a support having thereon at least one light-sensitive layer containing (1) an oxidation-reduction image-forming combination comprising (a) a silver salt oxidizing agent and (b) a reducing agent for said silver salt oxidizing agent (a) and (2) a catalytic amount of a light-sensitive silver halide or a compund capable of reacting with the silver salt oxidizing agent (a) to form a light-sensitive silver halide, the light-senstive layer further containing (3) at least one of a phthalazinone compound of the general formula (I)

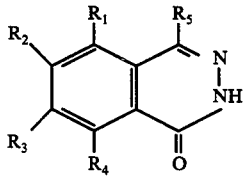

(I)

wherein $R_1$, $R_2$, $R_3$ and $R_4$ each represents a hydrogen atom, an alkyl group, an alkoxy group, a nitro group, an amino group or a hydroxyl group; $R_5$ represents a hydrogen atom, a halogen atom, an alkyl group, an aryl group, a substituted alkyl group, a substituted aryl group, a benzylidenehydrazino group, a pyridyl group, a vinyl group or a 2-substituted vinyl group; and $R_1$, $R_2$, $R_3$, $R_4$ and $R_5$ are not all simultaneously hydrogen atoms, and a 2,3-dihydro-9,4-phthalazinedione compound of the general formula (II)

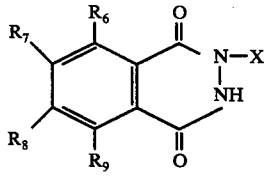

(II)

wherein $R_6$, $R_7$, $R_8$ and $R_9$ each represents a hydrogen atom, a halogen atom, a hydroxyl group, an alkyl group, an aryl group, an amino group, an alkylamino group, a nitro group, an alkoxy group, an alkylthio group or an acylamido group; and X represents a hydrogen atom, an aryl group, a pyridyl group, a 2-(2-pyridyl)-ethyl group, a 2-(4-pyridyl)ethyl group, a benzoyl group or a methyl group, and then heating the exposed material at a temperature of about 90° to about 180° C for a period for about 1 to 60 seconds.

2. The process of claim 1, wherein the amount of the compound of the general formula (I) is about 0.01 mol to 10 mols per mol of said silver salt oxidizing agent (a) and the amount of the compound of the general formula (II) is about 0.002 mol to 10 mols per mole of said silver salt oxidizing agent (a).

3. The process of claim 2, wherein the amount of the compound of the general formula (I) is 0.05 mol to 2 mols per mol of said silver salt oxidizing agent (a) and the amount of the compound of the general formula (II) is 0.005 mol to 0.5 mol per mole of said silver salt oxidizing agent (a).

4. The process of claim 1, wherein said silver salt oxidizing agent (a) is selected from the group consisting of aliphatic carboxylic acid silver salts, aromatic carboxylic acid silver salts, silver salts of organic compounds containing an imino group and silver salts of organic compounds containing a mercapto group.

5. The process of claim 1, wherein the amount of said reducing agent (b) is about 0.1 to 5 mols per mol of said silver salt oxidizing agent (a).

6. The process of claim 1, wherein said heating temperature is 100° to 170° C.

7. The process of claim 1, wherein said reducing agent is selected from p-ethoxyphenol, 2,2'-methylene-bis-(6-t-butyl-4-methylphenol), 2,2-bis(3,5-dimethyl-4-hydroxyphenyl)-propane or bisphenol A.

8. A heat developable light-sensitive material comprising a support having thereon at least one light-sensitive layer containing (1) an oxidation-reduction image-forming combination comprising (a) an organic silver salt oxidizing agent and (b) a reducing agent for said silver salt oxidizing agent (a) and (2) a catalytic amount of light-sensitive silver halide or a compound capable of reacting with the silver salt oxidizing agent (a) to form a light-sensitive silver halide, the light-sensitive layer further containing (3) at least one of (a) a phthalazinone compound of the general formula (I)

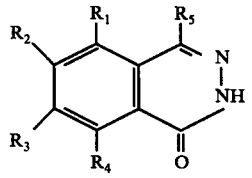

(I)

wherein $R_1$, $R_2$, $R_3$ and $R_4$ each represents a hydrogen atom, an alkyl group, an alkoxy group, a nitro group, an amino group or a hydroxyl group; $R_5$ represents a hydrogen atom, a halogen atom, an alkyl group, an aryl group, a substituted alkyl group, a substituted aryl group, a benzylidenehydrazino group, a pyridyl group, a vinyl group or a 2-substituted vinyl group; and $R_1$, $R_2$, $R_3$, $R_4$ and $R_5$ are not all simultaneously hydrogen atoms, and (b) a 2,3-dihydro-1,4-phthalazinedione compound of the general formula (II)

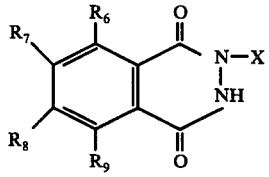

(II)

wherein $R_6$, $R_7$, $R_8$ and $R_9$ each represents a hydrogen atom, a halogen atom, a hydroxyl group, an alkyl group, an aryl group, an amino group, an alkylamino group, a nitro group, an alkoxy group, an alkylthio group or an acylamido group; and X represents a hydrogen atom, an aryl group, a pyridyl group, a 2-(2-pyridyl)-ethyl group, a 2-(4-pyridnyl)ethyl group, a benzoyl group or a methyl group, wherein the amount of the compound of the general formula (I) is about 0.01 mole to 10 moles per mole of said silver salt oxidizing agent (a) and the amount of the compound of the general formula (II) is about 0.002 mole to 10 moles per mole of said silver salt oxidizing agent (a); wherein said silver salt oxidizing agent (a) is a relatively light stable silver salt, which upon image-wise exposure to actinic radiation and heating is capable of forming silver images by an oxidation-reduction reaction with said reducing agent (b) due to the catalytic action of said silver halide (2) in the exposed area and wherein said reducing agent (b) is capable, upon heating, of forming said silver image by reducing said silver salt oxidizing agent (a) due to the catalytic action of said silver halide (2).

9. The light-sensitive material of claim 8, wherein said silver salt oxidizing agent (a) is selected from the group consisting of aliphatic carboxylic acid silver salts, aromatic carboxylic acid silver salts, silver salts of organic compounds containing an imino group and silver salts of organic compounds containing a mercapto group.

10. The light-sensitive material of claim 8, wherein said reducing agent (b) is selected from the group consisting of monohydroxybenzenes, dihydroxybiphenyls, di- and polyhydroxybenzenes, naphthols, naphthylamines, aminonaphthols, hydroxybinaphthyls, aminophenols, p-phenylene diamines, alkylene bisphenols, ascorbic acid or its derivatives, and pyrazolidones.

11. The light-sensitive material of claim 8, wherein the amount of said reducing agent (b) is about 0.1 to 5 moles per mol of said silver salt oxidizing agent (a).

* * * * *

UNITED STATES PATENT AND TRADEMARK OFFICE

CERTIFICATE OF CORRECTION

PATENT NO. : 4,076,534

DATED : February 28, 1978

INVENTOR(S) : Yasuhiro NOGUCHI et al

It is certified that error appears in the above-identified patent and that said Letters Patent are hereby corrected as shown below:

IN THE HEADING:

RELATED U.S. APPLICATION DATA:

Delete "Nov. 16, 1974" insert -- Oct. 16, 1974 --

FOREIGN APPLICATION PRIORITY DATA:

Delete "Nov. 16, 1973" insert -- Oct. 16, 1973 --

Delete "Nov. 17, 1973" insert -- Oct. 17, 1973 --

Signed and Sealed this

*First* Day of *August 1978*

[SEAL]

*Attest:*

RUTH C. MASON
*Attesting Officer*

DONALD W. BANNER
*Commissioner of Patents and Trademarks*